United States Patent [19]

Valls

[11] 4,070,878

[45] Jan. 31, 1978

[54] MACHINE FOR CONTINUOUSLY PROCESSING TEXTILE FABRICS

[76] Inventor: Conrado Valls, Torras y Bases, 53, 1°, 1ª, Barcelona, Spain

[21] Appl. No.: 725,436

[22] Filed: Sept. 22, 1976

[30] Foreign Application Priority Data

Oct. 4, 1975 Spain ..... 441823

[51] Int. Cl.[2] ..... D06B 21/00

[52] U.S. Cl. ..... 68/22 R; 68/62; 68/205 R

[58] Field of Search ..... 68/5 E, 22 R, 62, 175, 68/181 R, 184, 205 R, DIG. 5; 118/304, 314, 62; 134/9, 15, 64 R, 64 P, 122 R, 122 P

[56] References Cited

U.S. PATENT DOCUMENTS

| | | | |
|---|---|---|---|
| 2,042,678 | 6/1936 | Miller | 118/304 X |
| 2,539,947 | 1/1951 | De Klerk | 68/62 X |
| 3,019,630 | 2/1962 | Fleissner et al. | 68/DIG. 5 |
| 3,267,704 | 8/1966 | Muller | 68/62 |
| 3,315,501 | 4/1967 | Muller | 68/62 X |
| 3,717,015 | 2/1973 | Spencer | 68/205 R X |

FOREIGN PATENT DOCUMENTS

| | | | |
|---|---|---|---|
| 2,140 | 12/1960 | Japan | 68/205 R |

*Primary Examiner*—Philip R. Coe

[57] ABSTRACT

A machine is described for the processing of textile fabrics, arranged breadthwise and in a loop so that the fabrics run continuously, said machine having such structural characteristics as to achieve the most intimate possible contact of processing liquid with the fabric which, arranged as specified gradually is carried down the length of the machine.

6 Claims, 8 Drawing Figures

MACHINE FOR CONTINUOUSLY PROCESSING TEXTILE FABRICS

DESCRIPTION OF THE PREFERRED EMBODIMENT

The machine which is the subject of the present invention is characterized by a combination of high-pressure liquid jets acting over the entire breadth of the fabric being processed, said jets being very fine, the better to penetrate the fabric. The jets are projected by special nozzles, placed transversely in relation to the cloth and tangential to it, which act upon the fabric at the point where there is a receiving piece having an opening, parallel to and much broader than the aforementioned nozzles, which allows the partial or total passage of the liquid after it has passed through the textile band.

In addition to the aforementioned nozzles, the machine in question also has a system of supporting drums provided with fine wire or equivalent elements forming segments having a wire mesh placed above them for the reception of the textile band as well as to support the same while it is being processed by the liquid.

In addition, the machine according to this invention also comprises two pressure cylinders placed so that they act at the exit point of the textile band and provided therebelow with two low-pressure jets which impregnate the fabric with liquid, achieving by means of rollers of adequate hardness, improved treatment of the textile fabric by means of pressure.

The invention will be more specifically illustrated by the following drawings and the description relating thereto, wherein.

Figure 3:
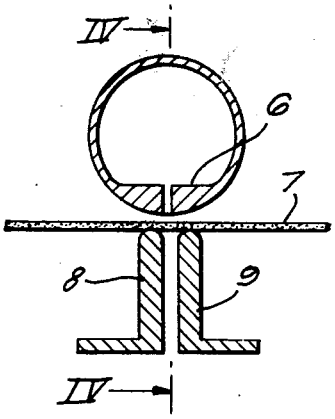
FIGS. 3 and 4 represent a detailed cross-section of the nozzles.
Figure 4:
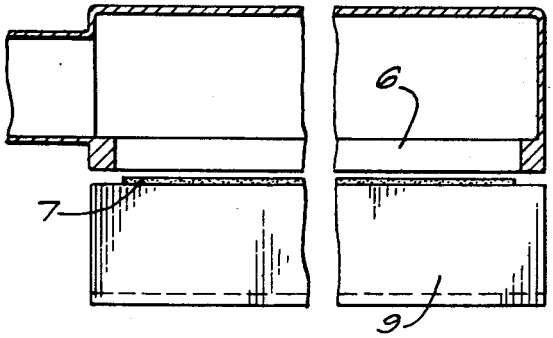

As shown in the foregoing figures, the machine of the subject invention has a main processing chamber 1 where several linear nozzles are arranged as in 2, 3, 4 and 5, the structure of which is shown in detail in FIGS. 3 and 4. As can be seen, the nozzles have tubular cavities in which a fine radial nozzle 6 opens transversely with respect to the width of the textile band, said nozzle being, for example, approximately 2 or 3 tenths of a millimeter in width and able to project a jet of liquid at high pressure against the textile band 7 which is mechanically guided to pass in front of said nozzles and tangentially to it, so that the liquid partially or totally passes through said textile band. The action of the nozzles FIG. 3 is completed by a support in the form of a slit formed by two braces or similar members 8 and 9, separated from each other by a small space but of considerably greater breadth than the aperture of nozzle 6 for receiving the liquid that has passed through the textile band. Said braces 8 and 9 are movably constructed to approach each other or separate in order to attain the desired width for form a channel for receiving the liquid from the nozzle.

Figure 5:
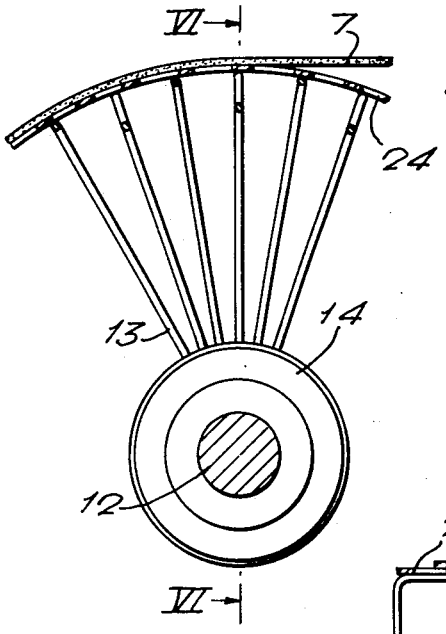
FIGS. 5 and 6 show details of the supporting wire drum for the textile band.
Figure 6:
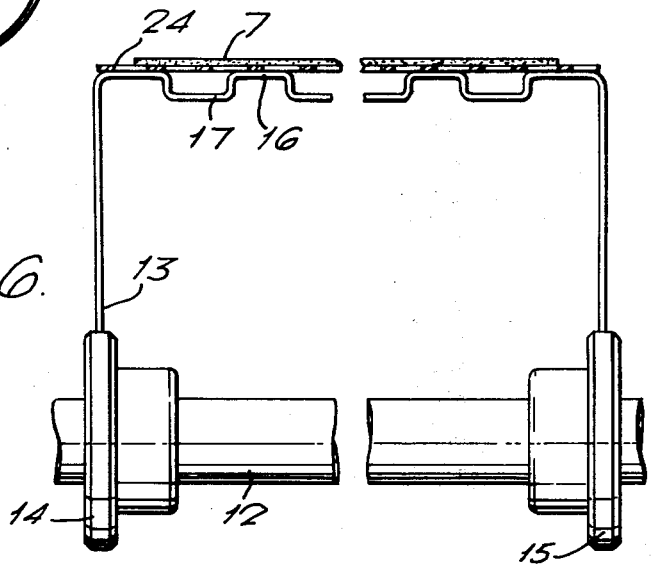
Figure 7:
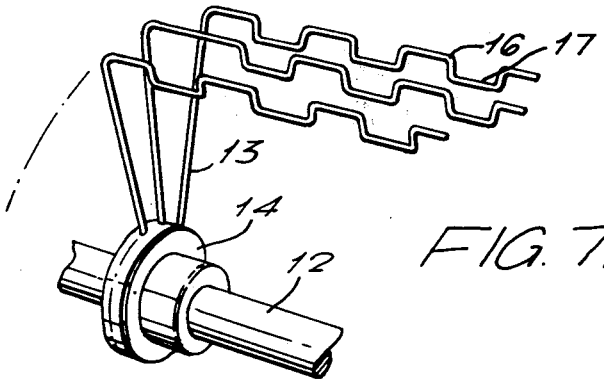
FIG. 7 is a view in perspective and in detail of the aforementioned drum.

The aforesaid nozzles may also act, as shown, at the extremes of the main chamber 1, over corresponding drums 10 and 11, the detailed structure of which is shown in FIGS. 5, 6 and 7.

The aforesaid drums consist of a hub or central axle 12 and multiple wire parts 13 radiating from the rings with plates at each end 14 and 15 solidly attached to the axle 12, and extending longitudinally of axle 12 to form a series of projections 16 and indentations 17, in order to allow the textile band to receive the processing liquid that passes through it. A wire mesh 24 is fitted on the periphery of the wire drum.

The main treatment chamber 1 has removable access lids 18, 19 and 43 which improve the performance of the entire zone of nozzles, drums and adjustable supports.

In addition, the machine is complemented by a set of upper rollers 20 and 21 placed at the exit of the machine which, together with the low-pressure nozzles 22 and 23, located before arriving at said cylinder and near the tangency zone, dispense fresh treating liquid, which may be water for washing if so desired. The joint action of the jets towards the tangency zone and the interplay of appropriately hard rollers, make it possible to press out the liquid absorbed by the fabric, thus partially renewing it. In addition, the liquid not absorbed by the fabric acts by means of gravity and adherence to the textile band before reaching the rollers, thus improving the processing.

From the second wire drum 11 to the cylinders 20 and 21, a conventional stretching attachment 44 is located to prevent wrinkling of the fabric.

The machine connects through a small-diameter, vertical channel 25 with a lower tank 26 where a roller 27 receives the textile band coming from outside, allowing it to be fed back towards the interior of the connecting chamber 25 where a part of the treatment is carried out. The tank 26 has a given level of processing liquid 28 which is made to re-circulate, by means of a system of pumps, towards the impulsion nozzles, after passing through filters.

Figure 1:
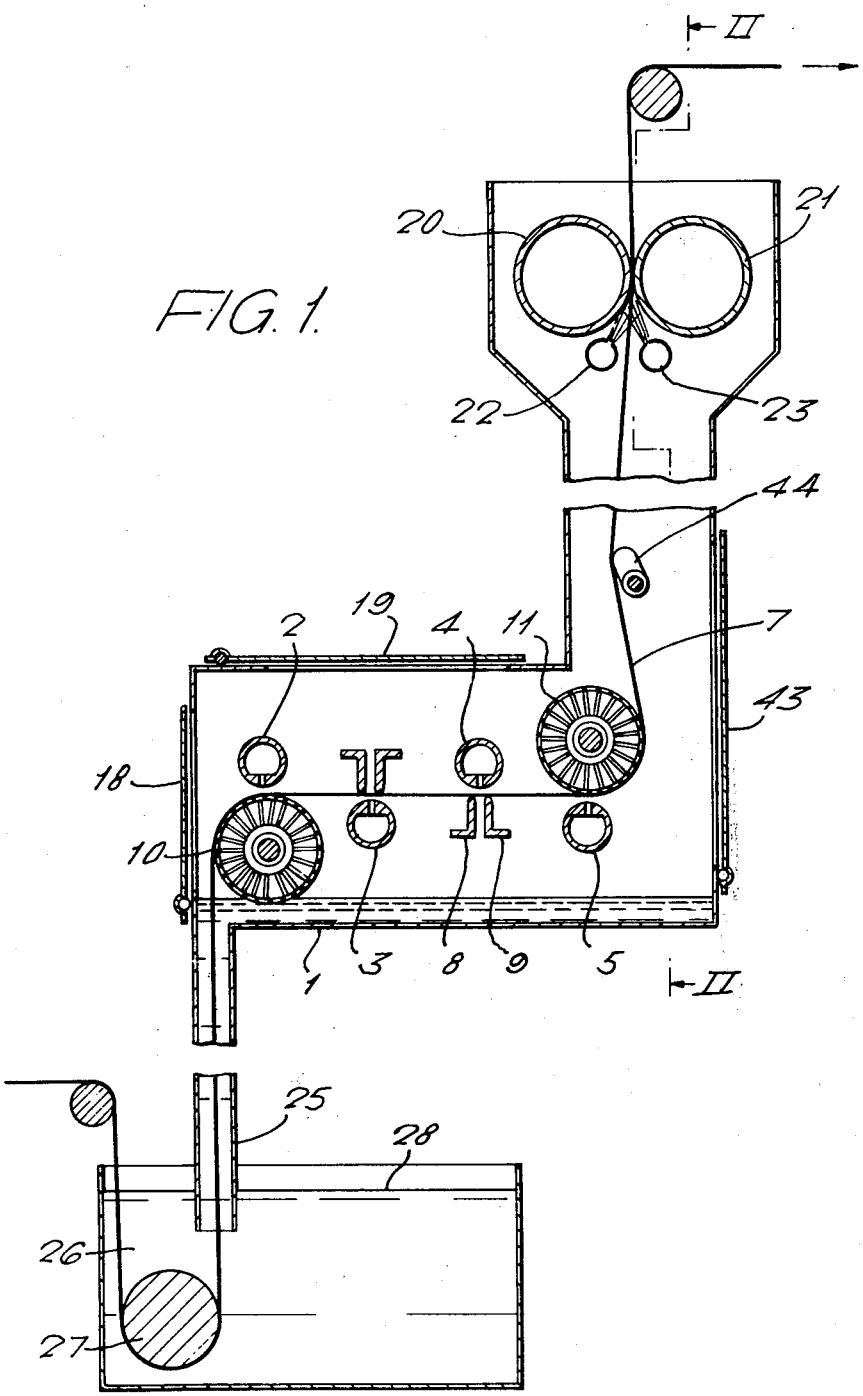
FIG. 1 is a diagrammatic section of a machine built according to the present invention.
Figure 2:
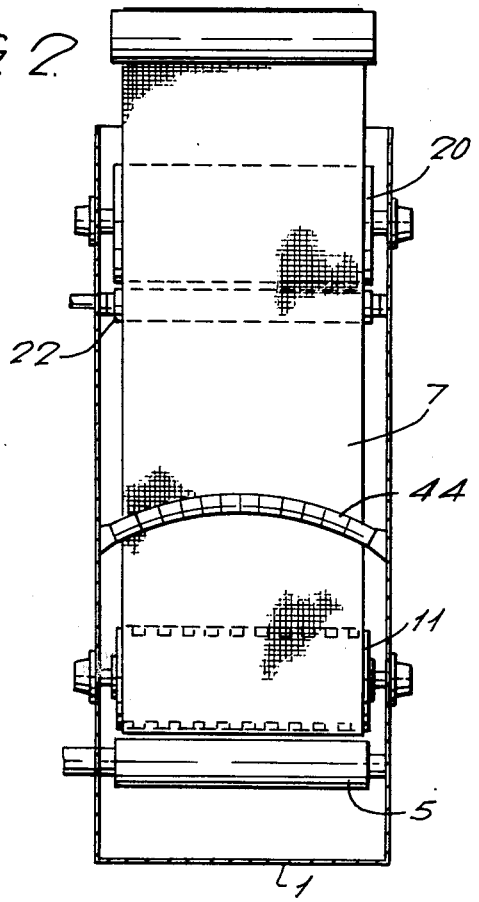
FIG. 2 shows a cross-section along the plane II—II of FIG. 1.
Figure 8:
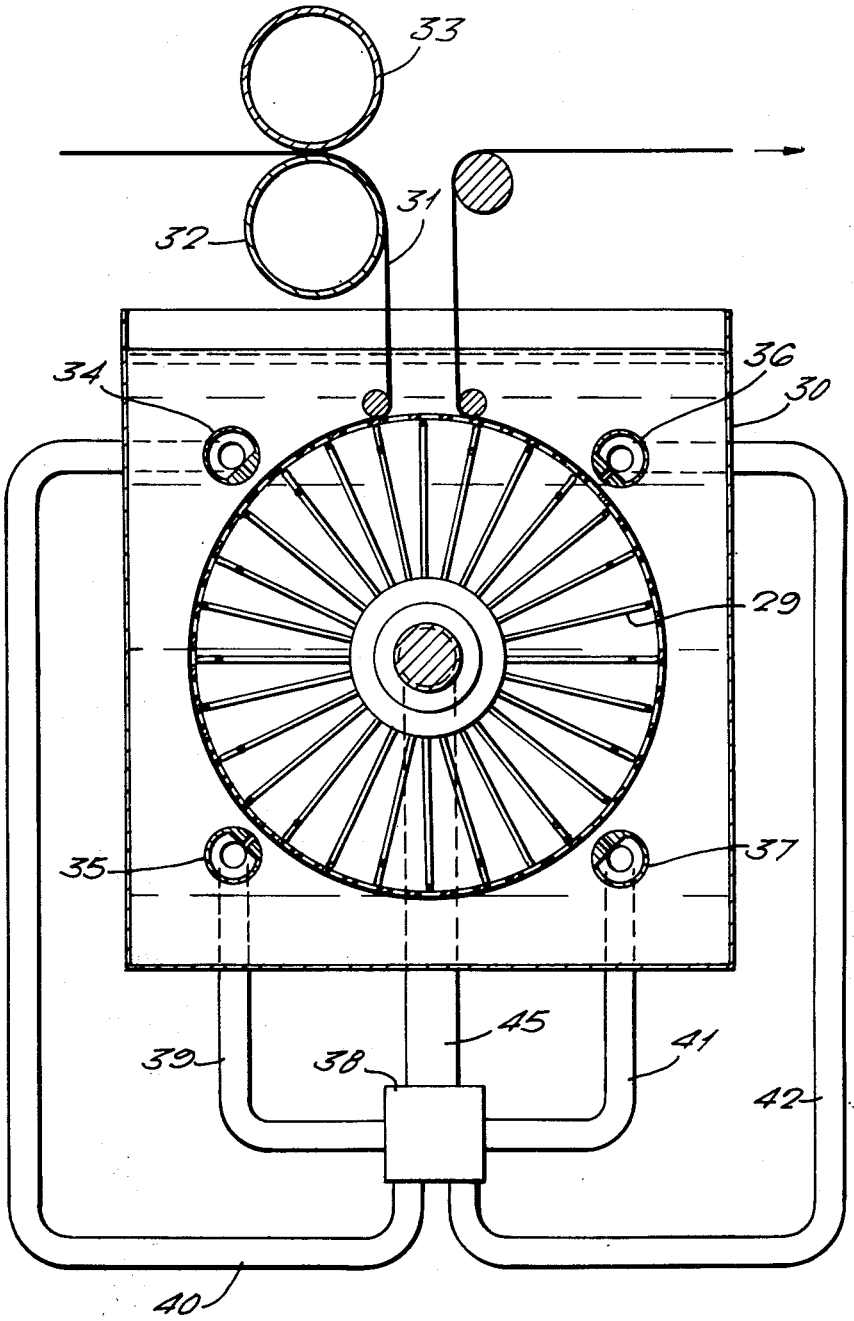
FIG. 8 is a diagrammatic section of an alternate construction for the collection tank of a machine according to this invention.

In the alternate receiving tank of FIG. 8, intended for knitted fabrics, the drum 29 is of considerable size and is so disposed in the interior of the chamber 30 corresponding to lower tank 26 in FIG. 1 that the textile band 31 enters said chamber from a pair of rollers 32 and 33 and fits over the rounded outer section of the aforesaid drum which is closed at the ends and has several nozzles such as 34, 35, 36 and 37, distributed over its periphery with their respective outlets for liquid disposed in radial fashion.

It is a characteristic of this alternate that the tangential velocity of the roller 32 is slightly greater than that of the drum 29 and also that the processing liquid should circulate from the interior of the drum 29 by means of lines 45 leading to the pump 38 and from this, by means of the pipes 39, 40, 41 and 42 towards the lineal nozzles, thus establishing a closed circuit which may be complemented by a system of filters and dispensers for the addition of processing products.

Resort may be had to such modifications and equivalents as fall within the spirit of the invention and the scope of the appended claims.

What is claimed is:

1. A machine for continuously processing textile fabrics comprising a main processing chamber provided with a plurality of nozzles placed transversally to a continuous textile band to be processed, each nozzle being substantially perpendicular to the textile band, with outlets tangential to said band, the aforesaid nozzles being provided with apertures adapted to eject strong, penetrating and uniform jets of processing liquid over the textile band, means situated opposite the nozzles to receive the processing liquid passing therethrough, said processing chamber terminating in an outlet provided with pressure cylinders and in an inlet comprising a lower passage connecting with a tank for collecting the processing liquid and receiving the textile band for supplementary processing.

2. A machine according to claim 1, wherein the means to receive the processing liquid comprise paired movable opposed parts adapted to adjust the size of the openings therebetween to positions wider than the apertures of the nozzles, in order to allow the passage of the processing liquid therethrough.

3. A machine according to claim 1, wherein the interior of the processing chamber is provided with drums covered with wire mesh, disposed opposite to the nozzles.

4. A machine according to claim 1, wherein low pressure nozzles are disposed in the vicinity of the outlet of the processing chamber in cooperation with the pressure cylinders to project fresh treatment liquid towards the tangency zone between said rollers.

5. A machine according to claim 1 wherein the collecting tank is provided with a drum over which the continuously moving textile band enters and is arranged, there being various nozzles arranged radially with respect to the drum and regularly distributed around it to facilitate application of the processing liquid upon the textile band.

6. A machine according to claim 5, having means to collect a processing-liquid from the interior of the drum and to direct, said liquid into a pump from which it is impelled by means of independent pipes to each of the nozzles surrounding the drum.

* * * * *